United States Patent [19]

Martelli

[11] Patent Number: 4,769,971

[45] Date of Patent: Sep. 13, 1988

[54] APPARATUS FOR INTRODUCING BLISTER-TYPE PRODUCTS AND THE LIKE INTO BOXES

[75] Inventor: Antonio Martelli, Bologna, Italy

[73] Assignee: S.T.M.-Sperimentazioni Tecniche Meccaniche-S.a.s. di Martelli Antonio & C., Rastignano Bo, Italy

[21] Appl. No.: 55,953

[22] Filed: Jun. 1, 1987

[30] Foreign Application Priority Data

Jun. 3, 1986 [IT] Italy ..... 3434 A/86

[51] Int. Cl.[4] ..... B65B 39/14

[52] U.S. Cl. ..... 53/252; 53/253; 53/272

[58] Field of Search ..... 53/252, 253, 258, 272

[56] References Cited

U.S. PATENT DOCUMENTS

| | | | |
|---|---|---|---|
| 3,505,777 | 4/1970 | Tsutsumi | 53/253 X |
| 3,812,643 | 5/1974 | Vergobbi | 53/253 X |
| 4,168,599 | 9/1979 | King | 53/253 X |
| 4,350,002 | 9/1982 | Focke | 53/252 X |
| 4,514,954 | 5/1985 | Anderson et al. | 53/272 X |

FOREIGN PATENT DOCUMENTS

| | | | |
|---|---|---|---|
| 902568 | 6/1972 | Canada | 53/252 |
| 1290474 | 3/1969 | Fed. Rep. of Germany | 53/253 |

*Primary Examiner*—James F. Coan
*Assistant Examiner*—Steven P. Weihrouch
*Attorney, Agent, or Firm*—Guido Modiano; Albert Josif

[57] ABSTRACT

The apparatus for introducing blister-type products and the like into boxes, comprises a carousel rotatable about a horizontal axis and composed of box retention means, angularly distributed around the axis and a product distribution drum. On the product distribution drum a plurality of containers adapted for containing the products, and a corresponding plurality of pushers, are mounted slideable in a direction extending parallel to the axis and aligned with the box retention means. Fixed annular-cams are provided for controlling the sliding of the containers and the pushers so as to perform in succession the approach of each container to a related box and the introduction of the pusher into the container so as to push the products into the box.

4 Claims, 3 Drawing Sheets

APPARATUS FOR INTRODUCING BLISTER-TYPE PRODUCTS AND THE LIKE INTO BOXES

BACKGROUND OF THE INVENTION

The present invention relates to an apparatus for introducing blister-type products and the like substantially flat products into boxes.

As is known, the apparatuses currently employed to introduce products of the type specified into boxes comprise chain conveyor means arranged in a line to the side of pusher means. Suitable cam elements control the actuation of said pusher means which perform the insertion of the products into boxes conveyed by said chain means.

The above mentioned apparatuses, besides having a remarkable structural complexity, have a remarkable bulk, which makes their installation problematic; the difficulty is also often encountered in adjusting the apparatus for the different types of products and boxes.

SUMMARY OF INVENTION

The aim of the present invention is to provide an apparatus for introducing blister-type products into boxes which overcomes all of the problems encountered in the known apparatuses.

Within the above-cited aim, an object of the invention is to provide an apparatus for introducing blister-type products and the like into boxes, having particularly small dimensions.

A further object of the invention is to provide an apparatus for introducing blister-type products into boxes, which is simple in structure, safe and reliable in operation, and versatile in use with respect to different types of products.

This aim and these and other objects which will become apparent hereinafter are achieved, according to the invention, by the present apparatus for introducing blister-type products (2) and the like into boxes (3), characterized in that it comprises at least one carousel rotatable about a substantially horizontal axis and consisting of box (3) retention means (5), angularly distributed about said axis and at least one product distribution drum (4), on which a plurality of containers (12) for containing products, and a corresponding plurality of pusher means (13), are mounted slideable in a direction extending substantially parallel to said axis and aligned with said box (3) retention means (5), annular cam means (22,23) being further provided for controlling sliding of said containers (12) and said pusher means (13) so as to perform in succession the aproach of each container (12) to a related box (3) and the introduction of said pusher means (13) into the container (12) so as to push the products into the box (3) itself.

BRIEF DESCRIPTION OF THE DRAWINGS

The details of the invention will become apparent from the detailed description of a preferred embodiment of the apparatus for introducing products into boxes, illustrated only by way of non-limitative example in the accompanying drawings, wherein.

DESCRIPTION OF THE PREFERRED EMBODIMENTS

Figure 1:
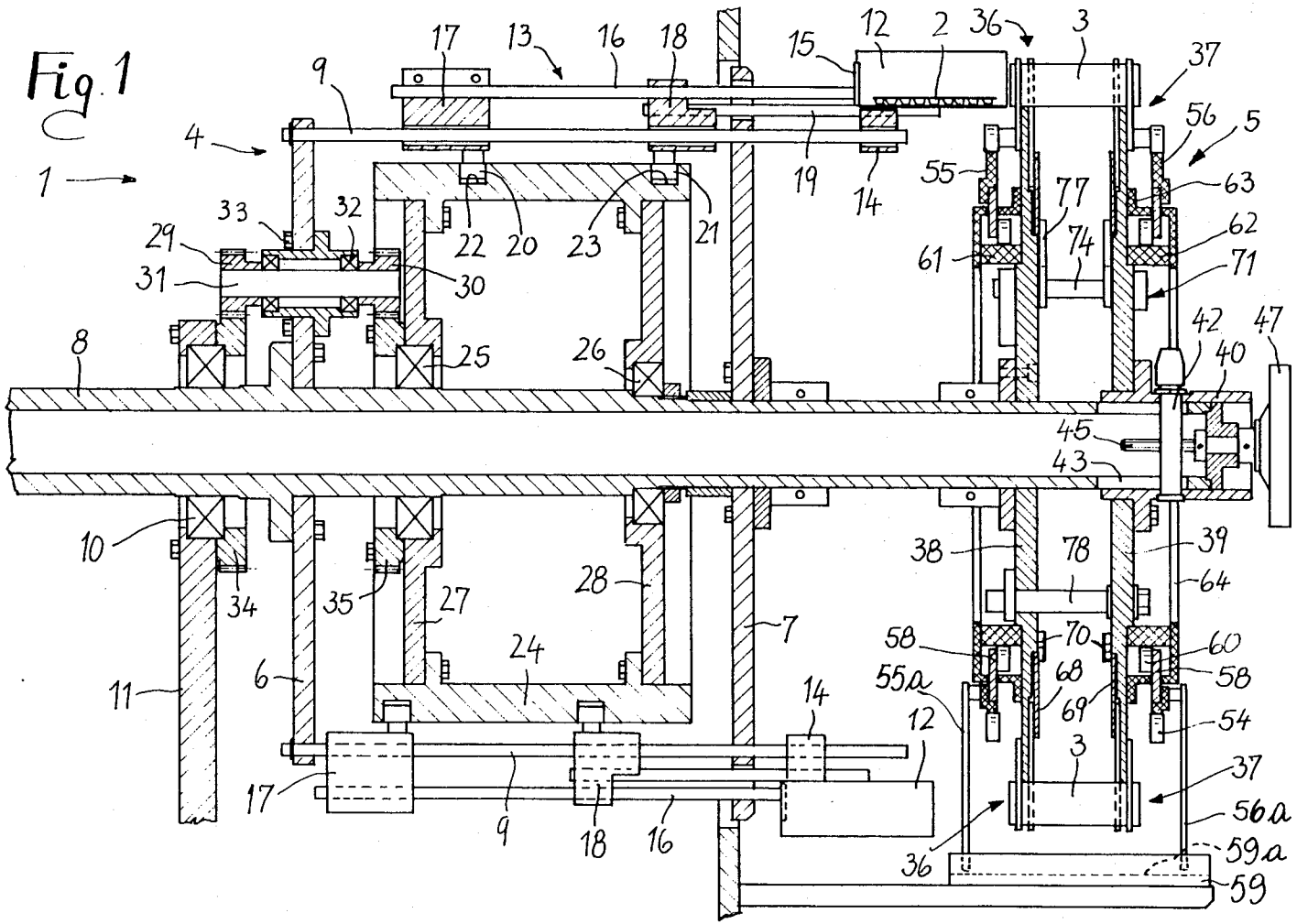
FIG. 1 is a longitudinal cross section view of the apparatus according to the invention.

With reference to the above described figures, the reference numeral 1 generally indicates the apparatus according to the invention, intended to perform the introduction of blister-type products 2 into the related boxes 3. The device 1 is substantially composed of a carousel formed by a drum 4 for the distribution of the products in the boxes and retention means 5 for the boxes to be filled.

The drum 4 consists of a pair of plates 6 and 7, located at a suitable distance from each other, rotatively fixed by flanges to a substantially horizontal drive shaft 8 of the carousel, and expediently inter-connected by a plurality of stems 9, distributed regularly at the periphery of the plates and protruding, at a portion thereof, from the drum towards said retention means 5. The drive shaft 8, advantageously has a tubular shape, is rotatably supported through roller bearings 10 by the fixed framework 11 of the device, and is operated by conventional motor means not illustrated in the drawing.

The stems 9 act as guides, for respective containers 12 intended to accommodate the products 2, and for related pusher means 13 adapted to push the products into the containers. The containers 12 have a U-shaped cross section open outwards and on the faces facing the direction of sliding on the respective stem 9, and are upwardly fixed to a block 14 which is guided on the portion of the stem which laterally protrudes from the drum.

The pusher means 13 comprise a pusher 15 which is adapted for being introduced into the container 12 and is fixed at the end of a rod 16 carried by a first body 17 which in turn is guided on the stem 9, between the plates 6 and 7. A second body 18 is also slideable between said plates on each stem 9, and is rigidly associated with a related block 14 by means of a rod 19 which passes through the plate 7. It should be noted that the rod 16 of each pusher 15 is in turn guided through the plate 7 and is slideably guided in a corresponding second body 18.

The bodies 17 and 18 downwardly bear respective rollers 20 and 21 rotatable about axes extending substantially radially with respect to the carousel. The rollers 20 and 21 respectively engage annular channels 22 and 23 provided on the outer surface of a cylinder 24 arranged coaxially inside the drum 24. The channels 22 and 23 in practice provide a pair of cams for guiding the rollers 20 and 21.

The cylinder 24 is carried by the shaft 8 through roller bearings 25, 26 which engage the heads 27, 28 of said cylinder. The cylinder 24 is kept fixed, as the shaft 8 rotates, by means of a gear, advantageously comprising a pair of satellite wheels 29, 30 mounted at the opposite ends of a small shaft 31 rotatably supported, by means of bearings 32, by a sleeve 33 which is inserted in a corresponding hole of the plate 6 and fixed to said plate. The satellite wheels 29, 30 engage with respective toothed wheels 34, 35 which are coaxial to the drive shaft 8 and respectively fixed to the framework 11 and to the head 27 of the cylinder 24.

The retention means 5 for the boxes to be filled comprise pairs of jaws 36, 37 supported by the carousel in front of the drum, and each pair is aligned with a respective container 12. The jaws 36 arranged towards the inside of the carousel are associated with the periphery of a disc 38 flanged on the shaft 8; the jaws 37 arranged on the outside are conversely associated with a disc 39 flanged to a sleeve 40 which is adjustably mounted axially on the shaft 8.

Figure 2:
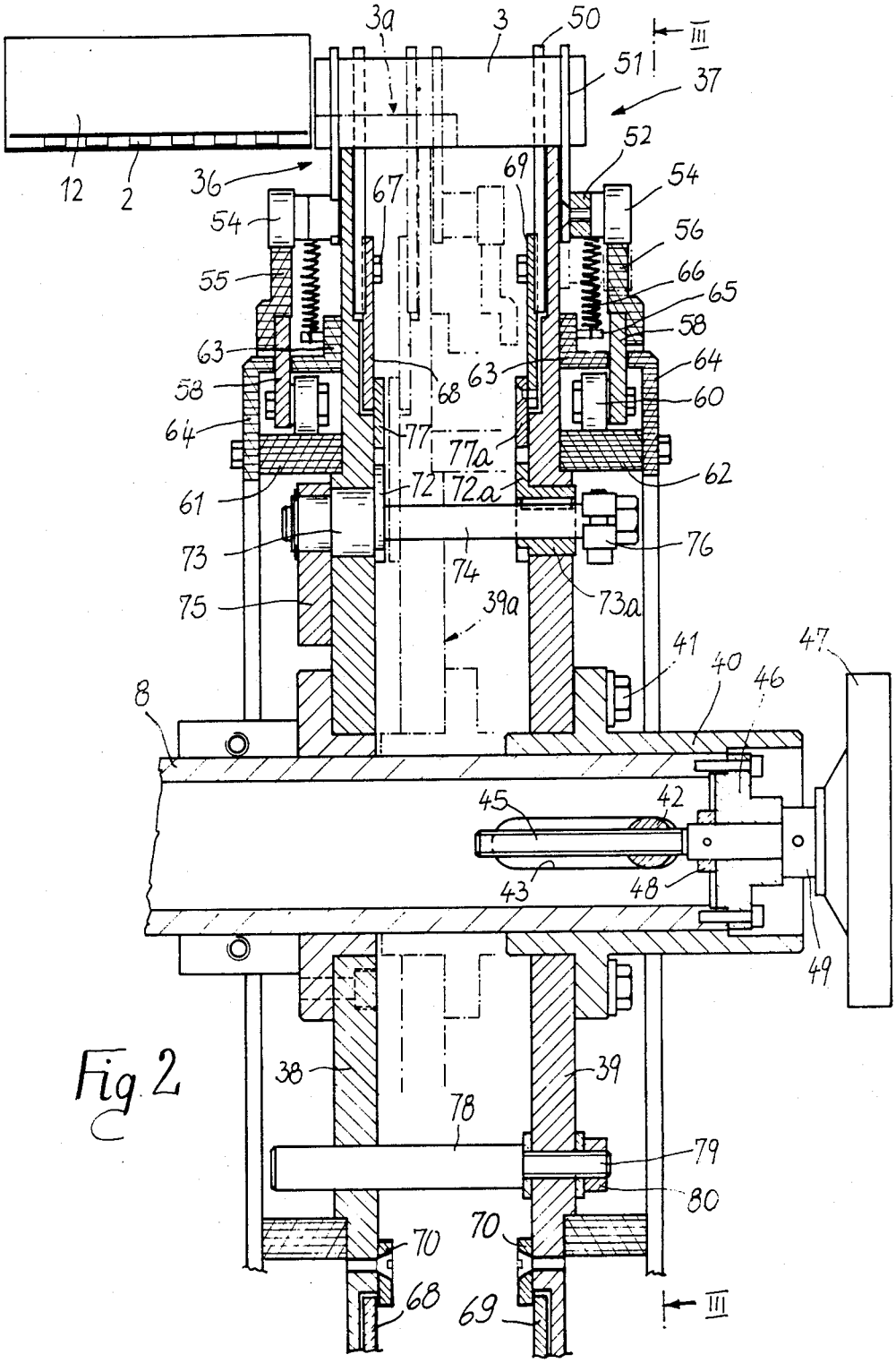
FIG. 2 is a longitudinal cross section detail view of said box retention means.

The sleeve 40, is expediently fixed to the disc 39 by screw means 41, and coupled to the shaft 8 by means of a diametral pin 42, which engages a longitudinal slot 43 of said drive shaft and can be blocked by means of conventional lever elements 44. The sleeve 40 is adjustable by means of a threaded shaft 45 which is rotatably supported by a bush 46 fixed frontally and coaxial with respect to the drive shaft 8. The threaded shaft 45 can be operated by means of an adjustment wheel 47 and engages a corresponding internal thread provided diametrically with respect to the pin 42. Advantageously, annular shoulders 48,49 prevent the threaded shaft 45 from sliding in the bush 46, so that the rotation of the adjustment wheel 47 determines the translatory motion of the pin 42, so as to move the disc 39 closer to the disc 38, as illustrated by the broken line 39*a* in FIG. 2, also for the securing of small boxes 3*a*.

Obviously, the adjustment wheel 47 may be either manually operated, or adapted to be operated by power assisted means.

The jaws 36, 37 expediently comprise a pair of fixed prongs 50 and a pair of movable prongs 51; the prongs 50 are arranged in an adjustable manner with respect to the prongs 51 at the periphery of the discs 38, 39, while the prongs 51 are each carried by a respective lever 52 articulated by a related pivot 53 to said discs. At the base of the prongs 51 of the jaws 36, 37, respective small rollers 54 are mounted which engage the profile of further annular cams 55, 56 fixed by screws 57 peripherally to respective rings 58 concentric to the shaft 8. Two arms 55*a*, 56*a* are rigidly associated with the cams 55, 56 and extend radially downwards, their ends engaging with a channel 59*a* of an element 59 rigidly associated with the fixed framework of the device. The arms 55*a*, 56*a* cause the cams 55, 56 to be rotatively stationary, but allow the motion of the cam 56 with respect to the cam 55 when the disc 39 is moved closer or further away with respect to the disc 38. The rings 58 are supported, by means of rollers 60 supported by said rings, on related cylinders 61, 62 which are centered on the outer faces of the discs 38, 39. Each of the two rings 58 is retained on the respective cylinder by a pair of annular profiles, an inner profile 63 and an outer profile 64, respectively fixed to the discs 38, 39 and to the cylinders 61, 62.

From the inner annular profiles 63, pins 65 axially protrude for the attachment of related springs 66 for the levers 52 of the prongs 51. The springs 66 are adapted for keeping the rollers 54 of the prongs 51 engaged on the annular cams 55, 56.

The fixed prongs 50 of the jaws 36, 37 are in turn fixed with screws 67 to related rings 68, 69 supported by respective shoulders 38*a*, 39*a* of the discs 38, 39 and retained by a plurality of washers 70 rigidly associated with said discs. In order to allow the adjustment of the distance between the prongs 50 and 51 of the jaws 36, 37 according to the dimensions of the boxes 3, it is possible to rotate simultaneously the rings 68, 69 (which support the prongs 50) with respect to the discs 38, 39 (which support the prongs 51) by means of an eccentric device 71.

The device 71 substantially consists of a pair of eccentrics 72, 72*a* with a circular profile rigidly associated at the front to respective bushes 73, 73*a* which are accommodated in corresponding holes formed coaxially in the discs 38, 39. The bushes 73, 73*a* are keyed on a shaft 74 of which one end is rotatable in a support 75 fixed to the disc 38,. while the other end can be locked by a small clamp 76 fixed to the disc 39. The eccentrics 72, 72*a* engage in diametrally opposite positions the housing of respective brackets 77, 77*a* which are fixed to the rings 68, 69 and protrude radially inwards.

The angular reference of the discs 38, 39 is ensured by a transverse pin 78 which has a threaded stem 79, locked by a nut 80 to the disc 39, and slideable, instead, in a hole of the disc 38.

The operation of the apparatus described hereinabove is as follows.

Upon rotation of the carousel, which carries the boxes 3 to be filled, the rollers 20 and 21 of the bodies 17 and 18 travel along the channels 22 and 23 of the cylinder 24, which is kept fixed to the framework 11 by means of the gear comprising the satellite wheels 29, 30. In this manner the sliding on the stems 9 of the pushers 13 and of the containers 12, rigidly associated respectively with said bodies 17 and 18 is controlled. In particular, the cams composed of the channels 22 and 23 control first the simultaneous motion of the bodies 17 and 18 towards the box retention means 5, so as to move the container 12 to associate with a related box, in which the product 2, previously deposited in said container, is to be transferred. Subsequently the cam 22 controls a further advancing stroke of the body 17, so that the pusher 15 enters the container 12, thus pushing the product inside the box.

Once the introduction of the product into the box has ended, the same cams 22 and 23 actuate the return of the container and the pusher to their initial positions.

Figure 3:
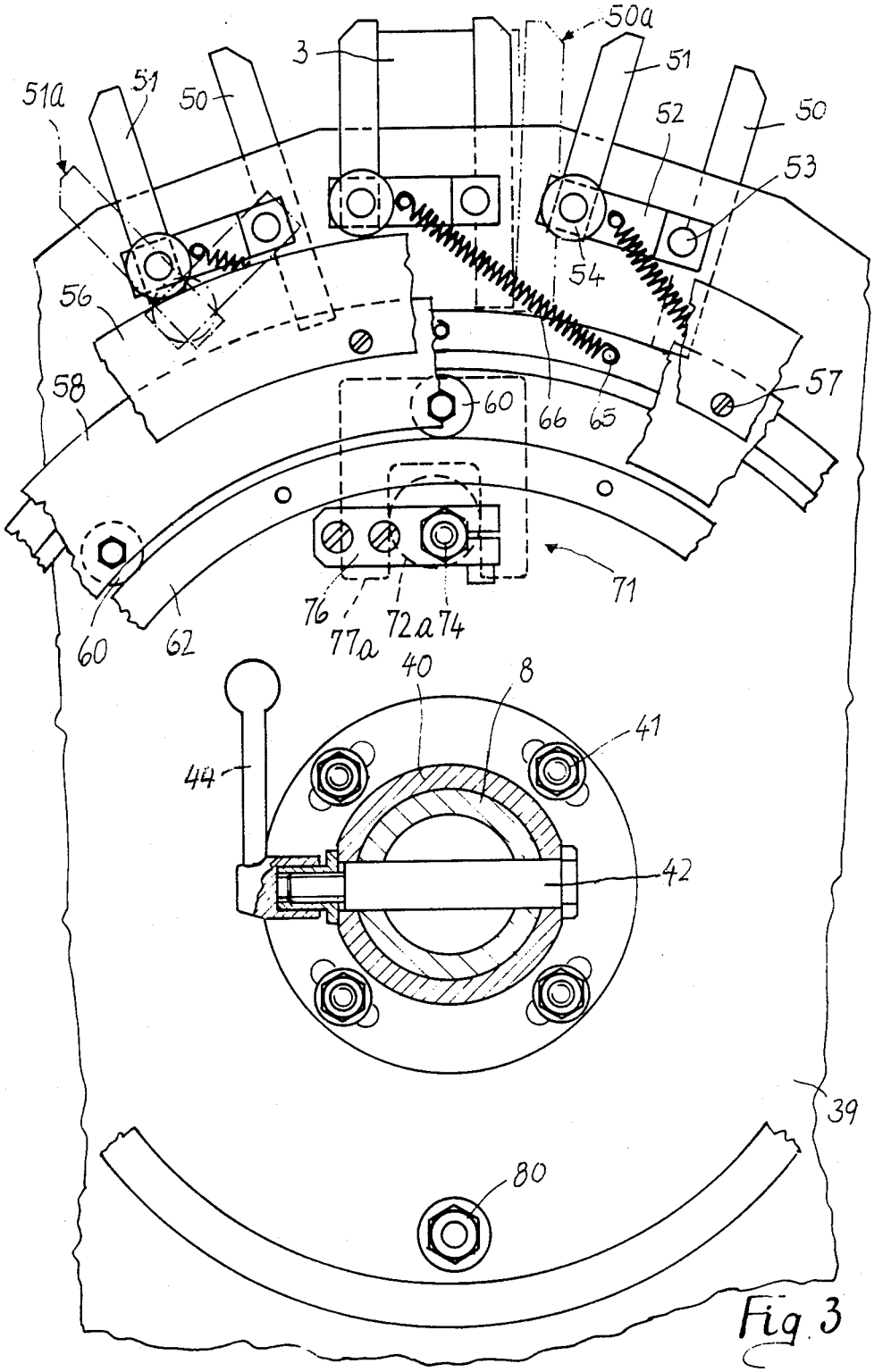
FIG. 3 is a fragmentary sectional view of said retention means, as taken along the plane III—III of FIG. 2.

The boxes 3 are gripped between the fixed prongs 50 and the movable prongs 51 of the jaws 36 and 37. The opening of said movable prongs is controlled, as the carousel rotates, by the annular cams 55, 56 on which roll the rollers 54 returned by the springs 66; the prong is illustrated in open position in FIG. 3 by the broken line 51*a*.

The retention means 5 allow adjustment, as required, of the jaws 36 and 37 according to the dimensions of the boxes 3. In particular, by rotating the adjustment wheel 47 it is possible to cause, by virtue of the coupling between the threaded shaft 45 and the pin 42, the sliding on the shaft 8 of the sleeve 40 which bears the disc 39, as illustrated by the broken line 39*a* in FIG. 2. To adjust the distance between the prongs 50 and 51 of the jaws 36, 37 it is necessary to act, instead, on the eccentric device 71. Rotation of the shaft 74 of this device which bears the eccentrics 72, 72*a*, causes angular rotation of the rings 68, 69 with respect to the discs 38, 39 and consequently the movement of the fixed prongs, as illustrated by the broken line 50*a* in FIG. 3.

In the practical embodiment of the invention, the materials employed, the shape and the dimensions can be any according to the requirements.

I claim:

1. Apparatus for introducing substantially flat products into boxes each having an open end and comprising a framework, a drive shaft rotatably supported according to a horizontal axis by said framework, box retention means mounted on said shaft and angularly distributed thereon, said retention means including jaw means for retaining the boxes with the open end facing a direction parallel to said drive shaft, stationary cam means controlling said jaw means to retain and release the boxes introduced therebetween, a drum element coaxially mounted on said drive shaft, said drum element including a pair of plates rotatively fixed on said drive shaft and stem means connecting said plates and extending parallel to said drive shaft, one of said plates being contiguous to said box retention means and the other one being opposite to said contiguous plate with respect to said box retention means, said stem means having a portion protruding from said contiguous plate towards said box retention means, container means slidingly supported on said portions, said container means being open in a direction parallel to said portions and facing said jaw means, pusher means slidingly supported on said stem means and in alignment with said container means, a cam cylinder arranged inside said drum element and rotatably carried by said drive shaft and means for keeping said cam cylinder stationary with respect to said drive shaft, rod means for operatively connecting said container and pusher means to said cam cylinder, said cam cylinder controlling said rod means to perform in succession approach of each container means to a related box and introduction of said pusher means into the container so as to expel the products into said box.

2. Apparatus according to claim 1 wherein said means for keeping said cam cylinder stationary with respect to said drive shaft comprise a shaft parallel to the drive shaft and rotatably supported on the plate opposite to said contiguous plate, and having opposite ends extending inside said drum and to the oneside thereof respectively, a pair of satellite wheels, rigidly secured to said shaft at the opposite ends thereof, a toothed wheel secured to said cam cylinder concentrically to said drive shaft and a toothed wheel secured to said framework outside said drum element, said toothed wheels being in engagement with said satellite wheels.

3. Apparatus according to claim 1 wherein said box retention means comprise a first disc rotatively fixed to said drive shaft, a second disc rotatively associated to said first disc and axially movable with respect thereof, means for axially adjusting said second disc with respect to said first disc, jaw means arranged at the periphery of said discs and aligned with said container means, each jaw means including fixed prongs and movable prongs, stationary annular cams being provided controlling said movable prongs between a gripping and a releasing position of said boxes.

4. Apparatus according to claim 3 comprising a pair of prongs supported on a respective disc and concentrically thereto, said fixed prongs being fixed on said rings and an eccentric device being provided to angularly adjust said rings with respect to said discs.

* * * * *